US009744572B2

(12) United States Patent
Englent

(10) Patent No.: US 9,744,572 B2
(45) Date of Patent: Aug. 29, 2017

(54) APPARATUS FOR REMOVING SOLIDS FROM SEWERS

(71) Applicant: Robert Andrew Englent, Stockton, CA (US)

(72) Inventor: Robert Andrew Englent, Stockton, CA (US)

( * ) Notice: Subject to any disclaimer, the term of this patent is extended or adjusted under 35 U.S.C. 154(b) by 16 days.

(21) Appl. No.: 14/672,902

(22) Filed: Mar. 30, 2015

(65) Prior Publication Data

US 2016/0288176 A1 Oct. 6, 2016

(51) Int. Cl.

| | |
|---|---|
| ***B08B 9/049*** | (2006.01) |
| ***B08B 9/053*** | (2006.01) |
| ***E03F 9/00*** | (2006.01) |
| ***B08B 9/055*** | (2006.01) |

(52) U.S. Cl.

CPC ..... *B08B 9/0553* (2013.01); *B08B 9/0497* (2013.01); *E03F 9/00* (2013.01); *E03F 9/002* (2013.01); *E03F 9/007* (2013.01)

(58) Field of Classification Search

CPC ..... B08B 9/0553; B08B 9/0558; E03F 9/002
See application file for complete search history.

(56) References Cited

U.S. PATENT DOCUMENTS

| | | | | | |
|---|---|---|---|---|---|
| 1,344,249 | A * | 6/1920 | Stewart | E03F 9/002 | 137/240 |
| 2,454,008 | A * | 11/1948 | Robinson | E03F 9/002 | 15/104.31 |
| 3,181,192 | A * | 5/1965 | Truman | E03F 9/002 | 15/104.31 |
| 3,387,877 | A * | 6/1968 | Christodolu | E03B 9/18 | 294/104 |
| 4,364,141 | A * | 12/1982 | Crane | E03F 9/00 | 15/104.061 |

* cited by examiner

*Primary Examiner* — Randall Chin
(74) *Attorney, Agent, or Firm* — Antoinette M. Tease

(57) ABSTRACT

A sewer cleaning apparatus which has a hollow cylindrical body propelled by a plurality of water jets with a clam shell opening on the front of the apparatus operated by a plurality of piston assemblies that are attached to the sides of the cylindrical body. The apparatus is propelled by high pressure water ejected from the apparatus in a rearward direction. The high pressure water operates the piston assembly opening the clam shell and provides forward thrust for the apparatus allowing the hollow bucket type object to trap solids inside apparatus.

5 Claims, 8 Drawing Sheets

APPARATUS FOR REMOVING SOLIDS FROM SEWERS

CROSS-REFERENCES TO RELATED APPLICATIONS

Not applicable

FEDERALLY SPONSORED RESEARCH OR DEVELOPMENT STATEMENT

Not applicable

NAMES OF PARTIES TO A JOINT RESEARCH AGREEMENT

Not applicable

SEQUENCE LISTING

Not applicable

PRIOR DISCLOSURE STATEMENT

The current invention has not been previously disclosed. This specification is intended to be a full and clear disclosure of the invention disclosed herein.

BACKGROUND OF INVENTION

1. Field of the Invention

The present invention pertains to a new and improved apparatus for removing solids from sewers and, more particularly, the apparatus is a water jet propelled hollow cylindrical body designed to trap solids, so said solids can be mechanically removed from underground pipe lines.

2. Description of Prior Art

Various means have been developed to remove solids from trunk sewers, but these methods are difficult, time consuming, and expensive when compared to the present invention.

A wastewater collection system is the network of sewer pipes that carry wastewater from homes and businesses to a wastewater treatment plant. This network of sewer pipes is sized according to the volume of sewer flow carried. Large sewer lines are typically called trunk sewers. Trunk sewers are typically designed using minimum slopes which fail to maintain velocities necessary to keep solids suspended in the sewer flow. Due to the settling of solids, all sewers must be cleaned periodically to remove solids. If accumulated solids are not removed, organic solids will decompose causing hydrogen sulfide gases to be released. The build-up of accumulated solids can further reduce the capacity of the sewer pipe, which can cause a stoppage or overflow. The high volume of waters conveyed within trunk sewers further complicates removal of submerged solids.

There are several factors which complicate efforts to remove solid materials such as depth of the sewer, the depth of the sewer flow, and size of the access hole into the sewer. Each of these factors creates additional complications. For example, vacuum systems have a physical limit related to the vertical lift of water using vacuum, which is further complicated when attempting to remove solids submerged under water. Also, many underground pipe lines have access holes which are much smaller than the actual pipe. This limits the use of devices designed to use the water flowing around the device to dislodge and carry solids, because these methods rely on the device to be of a similar size as the pipe being cleaned, thereby making larger pipes very difficult to clean and remove solids from. Further complicating these efforts, larger pipes are also typically at greater depths below the surface. To overcome the limits associated with vacuum, U.S. Pat. No. 5,336,333 discloses a method for cleaning sewers using normal and injected water to suspend solids in a slurry and uses a submersible pump to move this slurry into a pressurized container. However, this method is limited by the additional mobilization and setup time required due to multiple pieces of equipment including, the submersible pump and several tanks. Also, this method requires a large amount of surface work area for the associated equipment which can impact local residents and traffic. Also, this method is more complex in operation due to the multiple components.

Reference also, U.S. Pat. No. 3,181,192, U.S. Pat. No. 2,454,008, and U.S. Pat. No. 2,128,650 which disclose cable operated sewer cleaning buckets. These references of prior art use similar clam shell type buckets, but these devices are pulled through the pipe on cables using surface mounted winches. The use of a cable system requires extensive setup time for multiple pieces of associated equipment, maintenance hole cable and/or bucket rollers, and require a cable to be run through the sewer.

Reference also, U.S. Pat. No. 4,364,141 discloses a sewer cleaning shoe with dam and jet nozzles and U.S. Pat. No. 4,819,314 and U.S. Pat. No. 3,080,265 disclose sewer cleaning jet nozzles, the aforementioned prior art is limited because dislodged material can only be removed manually using shovels and the like, or through the use of a vacuum apparatus operating under water within the pipe line. As previously mentioned, vacuuming of said material is difficult due to the high water levels typically associated with flowing trunk sewers, so often dislodged solids often cannot be removed.

The present invention is a substantial improvement of prior art and overcomes the one or more problems set forth above. In this respect, it is desirable to provide an apparatus for removing solids from sewers which is designed to be water jet propelled, dislodges solids within pipes, and also easily removes said solids from trunk sewers and like.

It is further desirable to provide an apparatus for removing solids from sewers or like which utilizes high pressure cleaning hose of a single jet/vac type truck which greatly reduces setup time involved with cable systems, surface work area required for multiple pieces of equipment, and greatly enhances efficiencies and effectiveness due to these benefits.

It is further desirable to provide an apparatus for removing solids from sewers or like which is designed to mechanically remove materials without the use of vacuum, which is ineffective in flooded sewers.

It is further desirable to provide an apparatus for removing solids from sewers or like which cleans and removes solids from a single maintenance hole or access point.

It is further desirable to provide an apparatus for removing solids from sewers or like which uses the supplied water pressure to control the bucket opening.

It is further desirable to provide an apparatus for removing solids from sewers or like which is designed to remove materials without the use of centrifugal pumping and the like which simplifies setup and operation as well as reduces costs.

It is further desirable to provide an apparatus for removing solids from sewers or like which does not require the apparatus to be of a similar size as the pipe from which solids are being removed.

Therefore, it can be appreciated that there exists a need for new and improved apparatus for removing solids from sewers or like which can be used to more efficiently and effectively to dislodge solids from pipes and mechanically remove solids from within. In this regard, the present invention substantially fulfills this need.

SUMMARY OF INVENTION

The present invention overcomes many of the shortcomings and limitations of the prior art discussed above and provides an apparatus which can easily travel the length of an underground trunk sewer or pipe line, and when retrieved, removes trapped solids from the pipe and mechanically removes these solids from the trunk sewer or pipe.

To attain this, the present invention contemplates a hollow cylindrical body which is propelled through a pipe using the thrust from ejected high pressure water or fluid. The first embodiment of the apparatus comprises of a clam shell opening at one end. The apparatus is constructed from thin gauges of stainless steel. The clam shell end being the front; the rear of the apparatus is open. The clam shell halves are hinged in the middle with short hinges. The clam shell is opened and closed through two sliding actuators on opposite sides of the bucket. The sliding actuators are connected at one end to a piston and spring assembly on each side of the bucket and on the other end to the two halves of the clam shell. At the rear of the bucket is a water jet manifold assembly or like designed to contain, direct, and eject high pressure water or fluid to propel the apparatus, actuate the piston assembly, and dislodge hardened solids. The manifold assembly is connected to the piston assemblies and directs high pressure water into the piston assemblies, which forces the clam shell open when the apparatus is under pressure. When the apparatus is not under pressure, springs attached to the sliding actuator and the rear of the bucket, close the clam shell.

The high pressure water is supplied through a Y-hose assembly connected to the rear of the apparatus on one end and a jet/vac sewer type truck hose on the other. The apparatus is lowered into and retrieved from a maintenance hole from the hose and hose reel of the jet/vac truck. When apparatus is being propelled through a trunk sewer or pipe, the high pressure water forces the clam bucket open. The water jets are directed in a downward, opposing direction so that the bucket stays in an upright position. When the high pressure water is turned off, forward motion of the apparatus stops and the clam shell closes trapping solids inside the bucket. When the apparatus is removed from the trunk sewer, maintenance hole, or pipe the Y-hose assembly is easily pushed to one side so that the solids can be vacuumed from inside the bucket using the jet/vac truck vacuum apparatus.

In an alternative embodiment, the sliding actuator which opens and closes the bucket could be operated using a battery operated linear actuator triggered by water pressure or tension.

In an alternative embodiment, the sliding actuator which opens and closes the bucket could be operated by mechanical means derived from the motion of the apparatus.

In an alternative embodiment not incorporating the clam shell, the bucket would have a fixed bullet type front which passes over and/or around solids, includes a plurality of perforated openings to drain trapped water, but still traps solids inside when retrieved.

In an alternative embodiment, the apparatus would be constructed from mild steel, carbon fiber, aluminum, or similar material.

In an alternative embodiment, the apparatus would be constructed from a mixture of steel, stainless steel, carbon fiber, or aluminum.

There has thus been outlined, the features of the invention in order that the detailed description thereof that follows may be better understood and in order that the present contribution to the art may be better appreciated.

As such, those skilled in the art will appreciate that the apparatus, upon which this disclosure is based, may readily be utilized for easily removing solids from other structures, areas, or pipes. It is important, therefore, that the claims be regarded as including such equivalent structures, areas or pipes insofar as they do not depart from the spirit and scope of the present invention.

BRIEF DESCRIPTION OF THE DRAWINGS

The invention will be better understood from the following Detailed Description when considered in connection with the accompanying drawings in which similar reference characters denote similar elements throughout the several views.

DETAILED DESCRIPTION OF THE INVENTION

For illustration purposes only, the following various embodiments of the apparatus for removing solids from sewers. This invention may, however, be embodied in many different forms and should not construed as limited to the embodiments set forth herein; rather, these embodiments are provided so that this disclosure will be thorough and complete, and will fully convey the scope of the invention to those skilled in the art.

Figure 1:
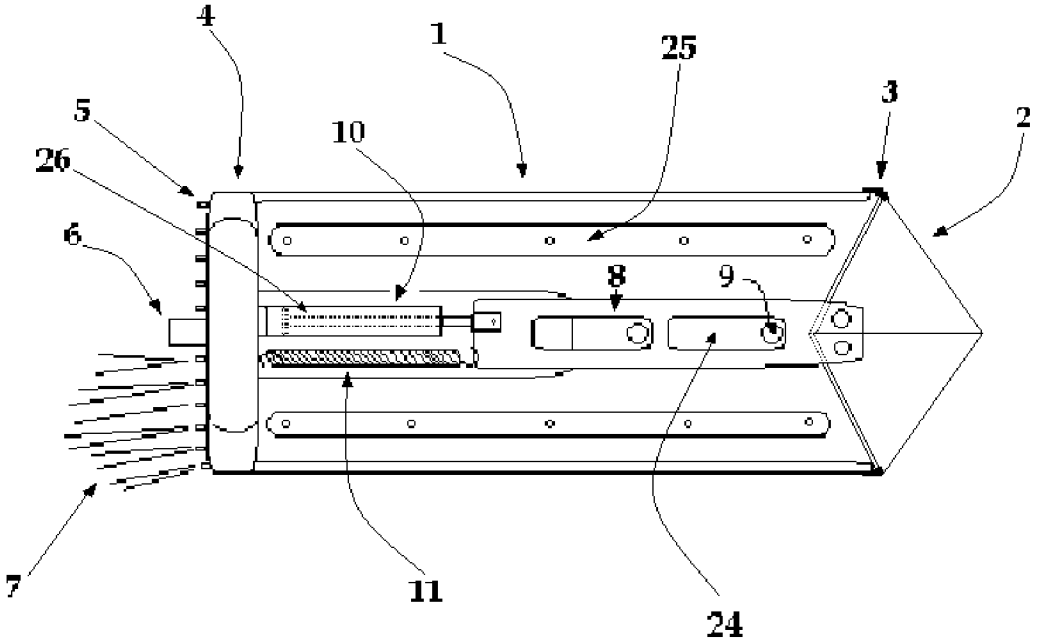
FIG. 1 is a perspective view of the preferred embodiment of the Apparatus for removing solids from sewers with the clam shell in the closed position.
Figure 2:
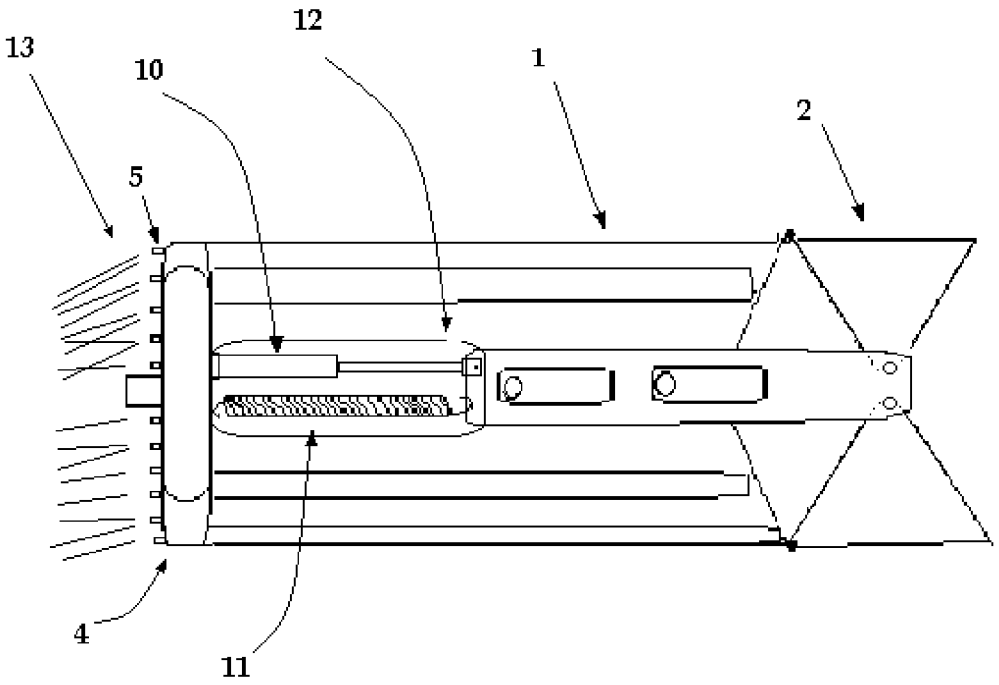
FIG. 2 is a perspective view of the preferred embodiment of the apparatus for removing solids from sewers with the clam shell in the open position.
Figure 3:
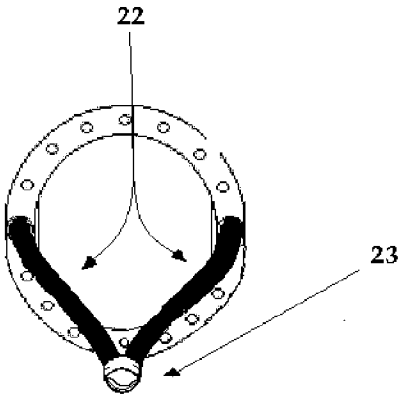
FIG. 3 is a front and rear view of the Apparatus with the clam shell in the closed position and the Y-hose connected to the apparatus.
Figure 3:
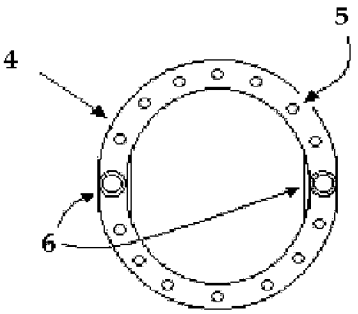
Figure 3:
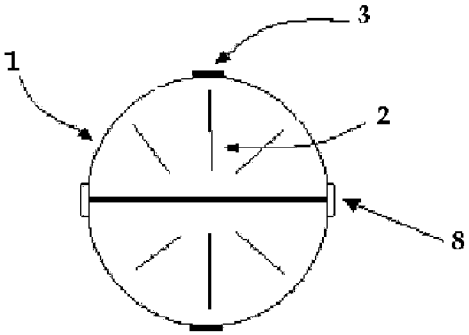

Referring to the drawings more particularly by reference numbers wherein like numerals refer to like parts, the numeral 1 in FIGS. 1, 2, and 3 identify the apparatus for removing solids from sewers.

Referring to FIG. 1, the apparatus for removing solids from sewers 1 is a hollow cylindrical body and in the preferred embodiment constructed from stainless steel. The apparatus and clam halves are constructed from thin gauge material and formed into the cylindrical shape. The apparatus would be constructed in various sizes depending on the size of the trunk sewer or pipe solids are being removed from and the size of the access to said pipes. As an example, if removing solids from a 6.10 mm (24") sewer pipe with an equally sized access, the apparatus would be approximately 304 mm (12") to 450 mm (18") in diameter and 762 mm (30") to 915 mm (36") in length. Replaceable wear strips 25 are even spaced around the perimeter of the apparatus and can be made of stainless steel or plastic or other type of material. The clam shell opening 2 is considered the front of the apparatus. The two clam shell halves open on a hinge 3. Due to the curvature of the bucket, the hinge is fairly short to allow the clam shell 2 to open. The clam shell is opened and closed by lateral movement (that is, movement in a direction perpendicular to the longitudinal axis of the apparatus) of the sliding actuator 8. The sliding actuator 8 travels on round guides 9 which are designed to retain the sliding actuator 8 and prevent all motion except lateral travel (of sliding actuator) to open and close the clam shell halves 2. The amount of linear travel of sliding actuator 8 is also limited by the guide slots 24 and the round guides 9. The sliding actuators are connected to the piston assembly 10, which when pressurized with water forces the clam shell halves 2 open. The piston assembly is tubular in shape and has an internal rod and piston assembly 26. When water pressure increases, the piston is extended which opens the clam shell 2. When water pressure decreases, the spring 11 exerts tension on the sliding actuator 8, which closes the clam shell 2.

Referring again to FIG. 1, at the rear of the bucket is a water jet manifold assembly 4 which is tubular in shape and designed to contain, direct, and eject high pressure water to propel the apparatus. The high pressure water is ejected from fixed orifice jets 5 that are threaded into the water jet manifold. The force of the water ejected from the jets 7 propels to the apparatus through the trunk sewer or pipe. The jets 5 at the top of the bucket are directed and angled in such a manner as to maintain the apparatus in an upright position while traveling through the pipe. The angle of the jets 5 are generally in a downward angle providing the necessary self-righting force 13 in FIG. 2. High pressure water is supplied through two threaded hose couplings 6 which are part of the water jet manifold 4.

Referring to FIG. 3, high pressure water is supplied through a Y-hose assembly 22 connected to the water jet manifold assembly 4 at the rear of the apparatus using two threaded hose couplings 6. A "2 into 1" hose fitting 23 connects the two pieces of hose making the Y-hose assembly. The sewer jetting hose 15 FIG. 4 from the jet/vac sewer type truck 21 FIG. 4 is connected to the "2 into 1" hose fitting 23.

Referring to FIG. 2, the apparatus 1 is shown as it would appear when pressurized with water. The piston assembly 10 is connected directly to the water jet manifold assembly 4 by a threaded connection or bolted flange. Water pressure from the water jet manifold assembly 4 is provided to the piston assembly through an internal fluid path between the direct connect of the water jet manifold 4 and the piston assembly 10. The water pressure from the water jet manifold assembly 4 moves into the piston assembly 10 and the pressure forces the internal ram 26 FIG. 1 to extend, which moves the sliding actuator 8 and forces the clam shell 2 open. In the open position, tension on the sliding actuator return spring 11 is increased and thus provides the force necessary to close the clam shell 2 when water pressure is decreased. When pressure is decreased, water inside the piston assembly 10 exits the rear of the piston assembly through the internal path between the piston assembly 10 and the water jet manifold 4 and drains out through the water jets 5.

Figure 4:
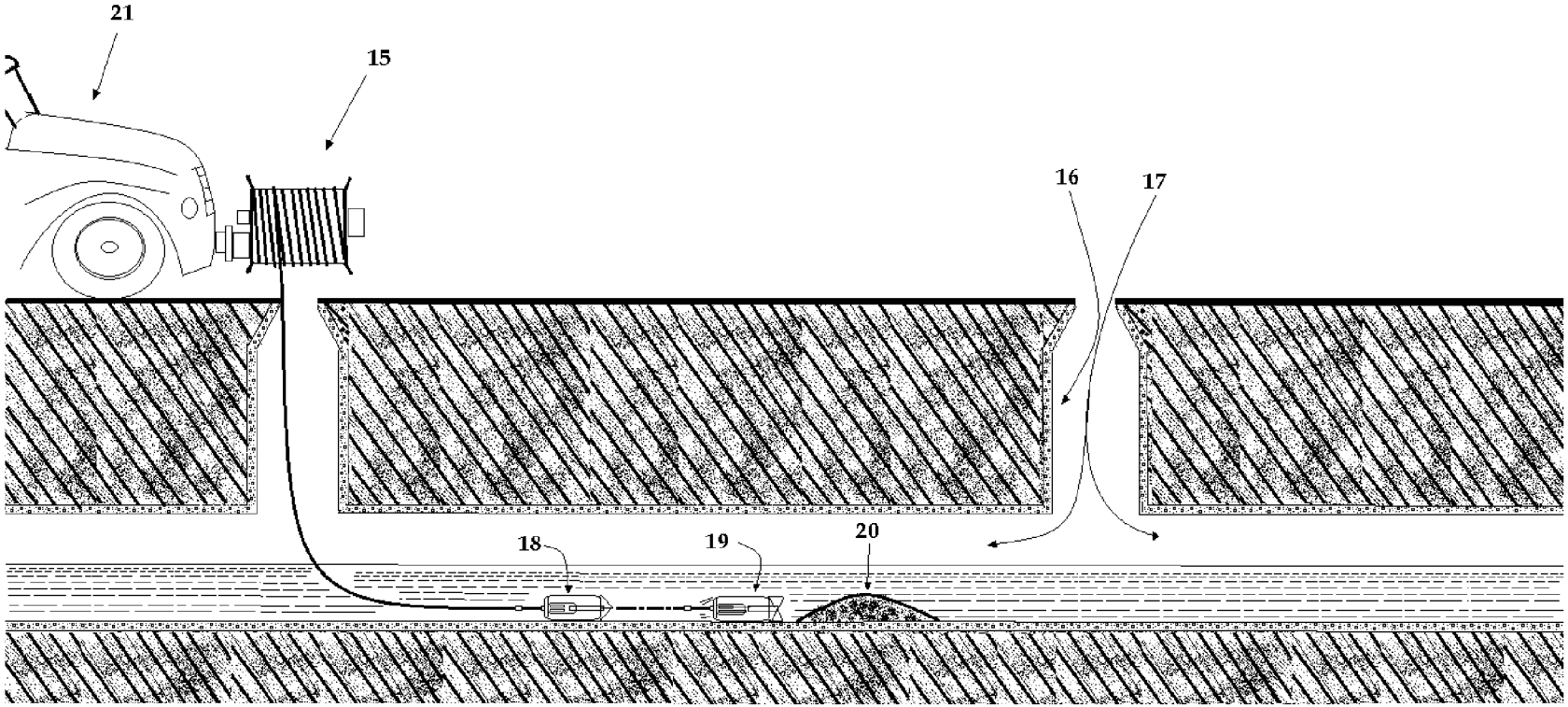
FIG. 4 is a cut-away view illustrating the method of use in a flooded trunk sewer using a jet/vac type truck.

Referring to FIG. 4, the apparatus for removing solids from sewers is shown in the best mode of operation. The apparatus for removing solids from sewers is lowered into and retrieved from a maintenance hole 16 from the hose 22 and hose reel 15 of the jet/vac truck 21. The apparatus for removing solids from sewers is lowered into the trunk sewer and front positioned to face the desired direction of travel. High pressure water is then supplied to the apparatus for removing solids from sewers through the hose 22. When high pressure water is supplied to the apparatus for removing solids from sewers the water jets propel the apparatus through the trunk sewer or pipe 19. As high pressure water is supplied, the water pressure acts on the piston assembly and forces the clam bucket open. Thus, when the apparatus is travelling into the sewer or pipe 19, the clam shell opening is in the open position allowing solids to be scooped into the apparatus. Thus the apparatus makes it easy to remove submerged solids 20 in a trunk sewer 17 or like pipe by using water jet propulsion to travel through the pipe, scooping solids, trapping said solids in the apparatus for mechanical removal. When the high pressure water is turned off or reduced, forward motion of the apparatus stops and the clam shell closes 18. As water pressure is decreased, the spring assembly 11, in FIG. 1 closes the clam shell opening and traps solids inside the apparatus. As a demonstration of the method of use, [19] the left-most apparatus shown in the sewer pipe of FIG. 4 illustrates the apparatus traveling into the submerged solids 20 and [18] the right-most apparatus shown in the sewer pipe of FIG. 4 illustrates the retrieval of the solids using the apparatus.

Figure 5:
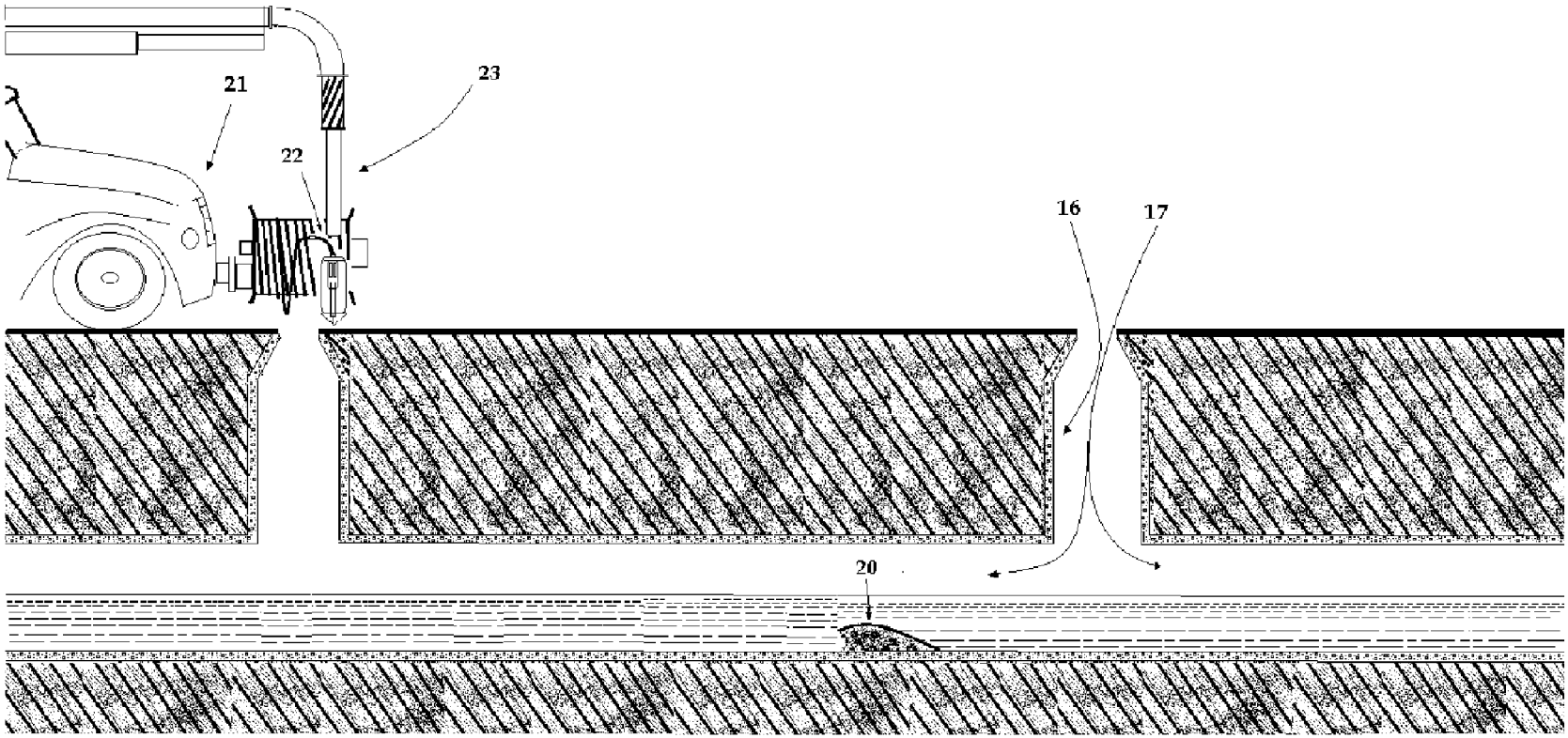
FIG. 5 is a cut-away view illustrating the method in which solids are vacuumed from the apparatus after the apparatus is removed from the pipe containing solids.

Referring now to FIG. 5, after the apparatus has been removed from the trunk sewer or pipe, the Y-hose assembly 22 is easily pushed to one side so that the solids can be physically dumped or vacuumed from inside the bucket using the jet/vac truck vacuum apparatus 23.

Figure 6:
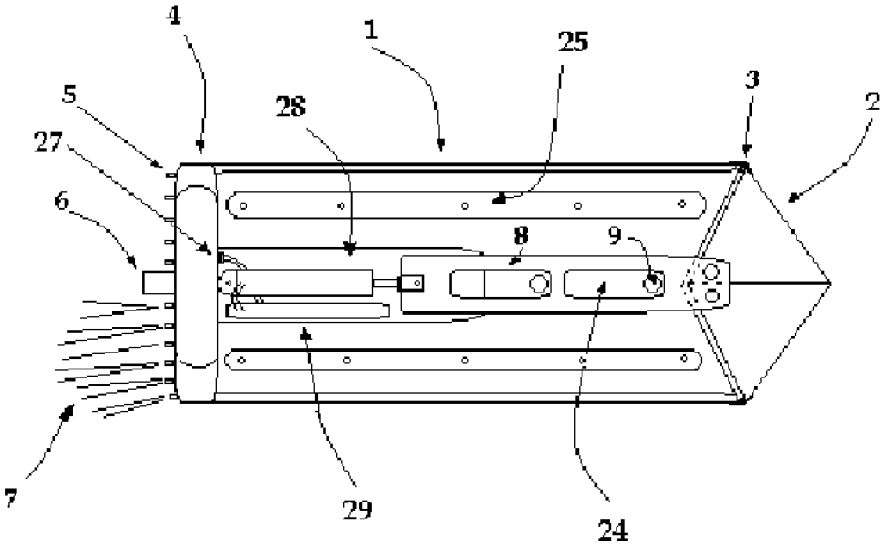
FIG. 6 is a perspective view of the apparatus using a battery operated linear actuator to open and close the clam shell.

Referring now to FIG. 6, the pressure switch 27 senses increased pressure in the water jet manifold 4 and signals the battery pack and controller unit 29 to open the clam shell. When pressure decreases, the battery pack and controller unit 29 closes the clam shell.

Figure 7:
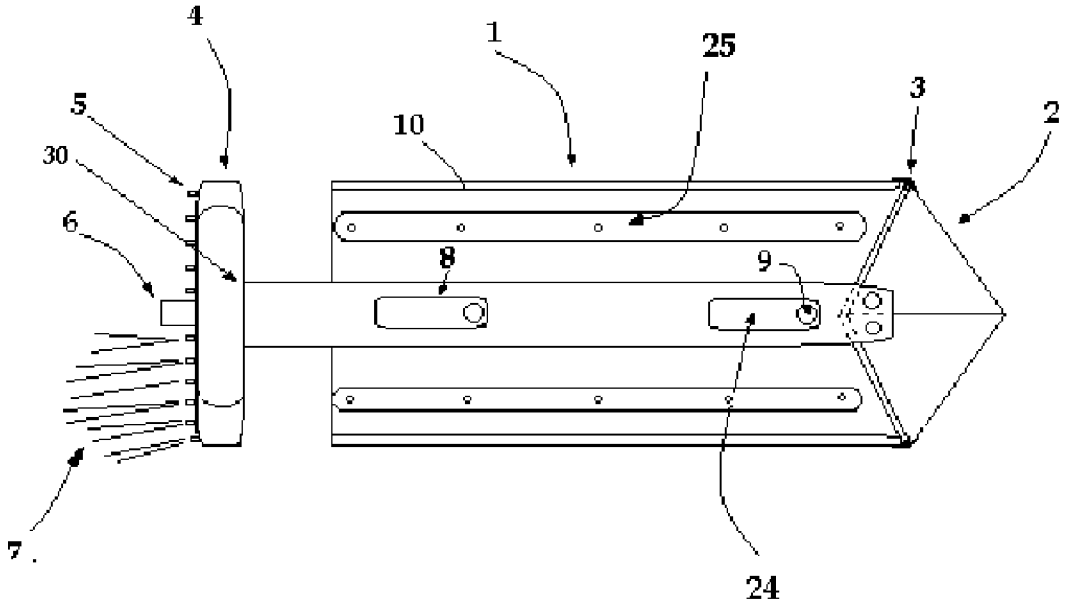
FIG. 7 is a perspective view of the apparatus operating the clam shell using mechanical means.

Referring now to FIG. 7, the clam shell 2 is opened when the jet force 7 pushes the sliding actuator 8 forward. In this embodiment, the jet manifold assembly 4 and the sliding actuator 8 are connected and move independent of the rest of the bucket.

Figure 8:
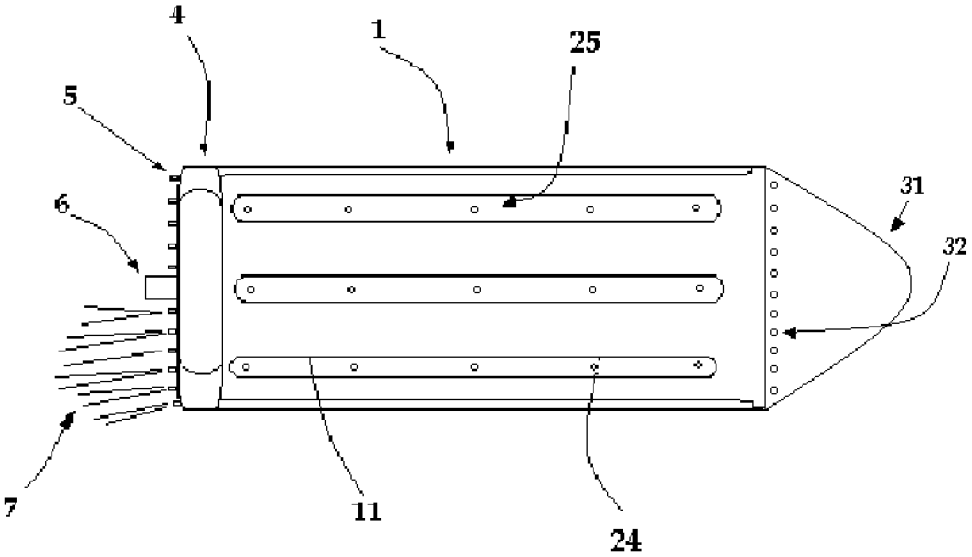
FIG. 8 is a perspective view of the apparatus with a fixed bullet nose and a plurality of perforations or holes to drain water.

Referring now to FIG. 8, which is an alternate embodiment to the clam shell embodiment described above, bullet nose 31 is fixed to the apparatus and solids pass around the apparatus. When the apparatus is retrieved, trapped water drains from the plurality of perforations or holes 32.

What is claimed as being new and desired to be protected by Letters Patent of the United States is as follows:

1. An apparatus for removing solids from sewers comprising:

a hollow cylindrical body and a plurality of high-pressure water jets configured to provide forward thrust to the cylindrical body; and wherein the cylindrical body has a front end, a first clam shell half and a second clam shell half, the first and second clam shell halves being hingedly attached to one another to form a clam shell, the clam shell being situated at the front end of the cylindrical body and operated by at least one piston assembly that is configured to open and close the clam shell on the front end of the cylindrical body in response to water pressure supplied by a water jet manifold assembly situated on a rear end of the apparatus.

2. The apparatus of claim 1, further comprising a battery-operated linear actuator configured to operate the clam shell, wherein the battery-operated linear actuator is triggered by the water pressure supplied by the water jet manifold assembly.

3. The apparatus of claim 1, further comprising a sliding actuator that is configured to open and close the clam shell;

wherein the sliding actuator travels on round guides that are configured to prevent the sliding actuator from moving in any direction except laterally;

wherein the degree of linear travel by the sliding actuator is limited by guide slots and round guides;

wherein the sliding actuator is connected to the at least one piston assembly, and wherein the piston assembly is configured to force the clam shell to open when the piston assembly is pressurized with water; and wherein the apparatus further comprises a sliding actuator return spring that is configured to exert pressure on the sliding actuator as the water pressure supplied by the water jet manifold assembly decreases, thereby closing the clam shell.

4. The apparatus of claim 3, wherein the water jet manifold assembly is tubular in shape and comprised of a water jet manifold and a plurality of fixed orifice jets that are threaded into the water jet manifold;

wherein the fixed orifice jets are angled so as to maintain the apparatus in a upright position and to propel it through a trunk sewer or sewer pipe as water is ejected from the jets; and wherein the water jet manifold is connected to one or more threaded hose couplings that are configured to deliver high-pressure water to the water jet manifold.

5. The apparatus of claim 4, wherein the at least one piston assembly is connected to the water jet manifold;

wherein water pressure from the water jet manifold assembly is provided to the piston assembly through an internal fluid path between the water jet manifold and the piston assembly;

wherein as water pressure moves from the water jet manifold assembly into the piston assembly, internal fluid pressure forces an internal ram to extend, thereby causing the sliding actuator to move laterally and the clam shell to open;

wherein as the clam shell opens, the sliding actuator return spring compresses, thereby creating a spring force; and wherein the sliding actuator return spring is configured to cause the clam shell to close when the spring force exceeds the force of the water pressure supplied by the water jet manifold assembly.

* * * * *